US008137166B2

(12) United States Patent
Hsu et al.

(10) Patent No.: US 8,137,166 B2
(45) Date of Patent: Mar. 20, 2012

(54) POLISHING PAD HAVING MICRO-GROOVES ON THE PAD SURFACE

(75) Inventors: Oscar K. Hsu, Chelmsford, MA (US); Marc C. Jin, Boston, MA (US); David Adam Wells, Hudson, NH (US); John Erik Aldeborgh, Boxford, MA (US)

(73) Assignee: Innopad, Inc., Wilmington, MA (US)

( * ) Notice: Subject to any disclaimer, the term of this patent is extended or adjusted under 35 U.S.C. 154(b) by 0 days.

(21) Appl. No.: 11/780,373

(22) Filed: Jul. 19, 2007

(65) Prior Publication Data

US 2008/0085661 A1 Apr. 10, 2008

Related U.S. Application Data

(60) Provisional application No. 60/831,595, filed on Jul. 19, 2006.

(51) Int. Cl.
*B24D 11/00* (2006.01)

(52) U.S. Cl. ..... 451/532; 451/527

(58) Field of Classification Search ..... 451/526–539; 51/298, 309

See application file for complete search history.

(56) References Cited

U.S. PATENT DOCUMENTS

| | | | | |
|---|---|---|---|---|
| 5,584,146 | A | 12/1996 | Shamouillan et al. | |
| 6,383,066 | B1 | 5/2002 | Chen et al. | |
| 2003/0003857 | A1 * | 1/2003 | Shimagaki et al. | 451/534 |
| 2003/0207661 | A1 | 11/2003 | Tregub et al. | |
| 2004/0014413 | A1 | 1/2004 | Kawahashi et al. | |
| 2004/0224622 | A1 * | 11/2004 | Sakurai et al. | 451/526 |
| 2004/0266326 | A1 | 12/2004 | Shiho et al. | |
| 2005/0255794 | A1 * | 11/2005 | Vangsness et al. | 451/36 |

FOREIGN PATENT DOCUMENTS

| | | |
|---|---|---|
| CN | 1592955 | 3/2005 |

OTHER PUBLICATIONS

International Search Report and Written Opinion dated Jul. 7, 2008 issued in International Patent Application No. PCT/US07/73921 (8 pages).

English language text of Chinese Office Action dated Jan. 29, 2010 issued in related Chinese Patent Application No. 200780032466.8.

Office Action from corresponding Taiwanese Application No. 096126187 dated Mar. 24, 2011. English translation attached.

* cited by examiner

*Primary Examiner* — Dung Van Nguyen

(74) *Attorney, Agent, or Firm* — Grossman, Tucker, Perreault & Pfleger, PLLC

(57) ABSTRACT

A polishing pad is provided herein, which may include a plurality of soluble fibers having a diameter in the range of about 5 to 80 micrometers, and an insoluble component. The pad may also pad include a first surface having a plurality of micro-grooves, wherein the soluble fibers form the micro-grooves in the pad. The micro-grooves may have a width and/or depth up to about 150 micrometers. In addition, a method of forming the polishing pad and a method of polishing a surface with the polishing pad is disclosed.

18 Claims, 4 Drawing Sheets

POLISHING PAD HAVING MICRO-GROOVES ON THE PAD SURFACE

CROSS-REFERENCE TO RELATED APPLICATIONS

The present application claims the benefit of U.S. Provisional Application No. 60/831,595, filed on Jul. 19, 2006.

FIELD OF INVENTION

The present invention relates to a polishing pad and, more specifically, a polishing pad including micro-grooves capable of regenerating themselves during polishing. The pads may be used in chemical mechanical polishing or other types of polishing for a given substrate, such as a semiconductor wafer.

BACKGROUND

In applying CMP (Chemical Mechanical Planarization) as a process step in the manufacture of micro-electronic devices such as semiconductor wafers, blanket silicone wafers and computer hard disks, a polishing pad may be used in conjunction with an abrasive-containing or abrasive-free slurry to affect planarization of the surface of the device. To achieve a high degree of planarity of the surface of the device, typically measured in the order of Angstroms, the slurry flow should be distributed uniformly between the surface of the device and the pad. To facilitate such uniform distribution of the slurry, a plurality of grooves or indentation structure may be provided on a polishing pad. The plurality of grooves may have individual groove widths of 0.010 inches to 0.050 inches, depths of 0.010 inches to 0.080 inches and distance between adjacent grooves of 0.12 inches to 0.25 inches, respectively.

While the grooves may provide the above-mentioned benefits, nevertheless, they may not be sufficient to effect local planarization on the die (or single microchip) level on a semiconductor wafer. This may be due to the relatively large differences between the grooves and the individual features, such as interconnects, on the microchip. Advanced ULSI and VLSI microchips, for example, may have feature sizes on the order of 0.35 micrometers (0.000014 inches) that are many times smaller than the width and depths of the individual grooves on the polishing pad. In addition, the feature sizes on a microchip are also thousands of times smaller than the distance between the adjacent grooves, which may result in non-uniform distribution of the slurry on a feature size level.

In an effort to improve upon the uniformity of local, feature-scale planarization, CMP pad manufacturers have, in some instances, provided asperities or high and low areas on the surface of the pads. These asperities may have a size ranged from 20 to over 100 micrometers. While, such asperities may be closer in size to that of the microchip features, as compared to the grooves, the asperities may change in shape and size during the polishing process, and may require continuous regeneration by abrading the polishing pad surface with a conditioner fitted with diamond abrasive particles. The diamond abrasive particles on the conditioner continuously scrape off the surface asperities that are deformed as a result of frictional contact between the pad, the slurry and the surface of the device, and expose new asperities to maintain consistency of planarization. The conditioning process, however, may be unstable, as it may utilize the sharp diamond particles to sever the deformed asperities. The severance of the deformed asperities may not be well controlled, resulting in changes in the size, shape and distribution of the asperities that in turn may cause variation in the uniformity of planarization. Furthermore, the frictional heat generated from conditioning may also contribute to the non-uniformity of planarization, by changing the surface properties of the pad, including properties such as shear modulus, hardness and compressibility.

SUMMARY

An aspect of the present invention relates to a polishing pad. The polishing pad may include a plurality of soluble fibers having a diameter in the range of about 5 to 80 micrometers, and an insoluble component. The pad may also include a first surface having a plurality of micro-grooves, wherein the soluble fibers form the micro-grooves in the pad. The micro-grooves may have a width and/or depth up to about 150 micrometers.

Another aspect of the invention relates to a method of providing a polishing pad. The polishing pad may be formed by providing a mold having a first half and a second half and a recess defined in said first half. A plurality of soluble fibers having a diameter in the range of about 5 to 80 micrometers and an insoluble component may be provided into the mold recess. The mold may be closed and heat and pressure may be applied to the plurality of soluble fibers and the insoluble component over a given period of time, thus forming the pad. The pad may also include a first surface having a plurality of micro-grooves and the micro-grooves may have a width and/or depth up to about 150 micrometers.

A further aspect of the present invention relates to a method of polishing a surface with a polishing pad. The method includes providing a substrate for polishing, providing an aqueous slurry on at least a portion of a surface of the substrate, and providing a pad comprising a plurality of soluble fibers having a diameter in the range of about 5 to 80 micrometers and an insoluble component. The surface of the substrate may be polished by interaction of the pad, the aqueous slurry and the substrate surface. The soluble fibers may then be dissolved forming a plurality of micro-grooves on a pad surface, wherein said micro-grooves may have a width and/or depth up to about 150 micrometers.

BRIEF DESCRIPTION OF DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION

The present disclosure relates to a polishing pad that provides a relatively high surface density of micro-grooves. The micro-grooves may be self-generating, that is, they may not be generated by the mechanical surface cutting action of a diamond conditioner used in CMP as described above. Rather, they may be formed by exposure of a soluble component of specified size in the polishing pad surface region to an aqueous slurry. Furthermore, the micro-grooves and their orientation in the surface region of the pad may be designed and optimized to meet the requirements of a particular CMP application. Therefore, an array of micro-grooves may be designed to be isotropic or may be completely randomized in orientation, or may provide for a specific pattern required for optimal planarization for a given microchip design.

The micro-grooves may have width and depths up to about 150 micrometers, and e.g., in the range of 5 to 150 micrometers (0.0002 in to 0.006 in), including all values and increments therein, and an average distance between adjacent micro-grooves in the range of about 10 to 2000 micrometers (0.004 in to 0.08 in), including all values and increments therein. Reference to an average distance between grooves ($\overline{D_g}$) is reference to the average distance between two adjacent grooves as shown, e.g. in FIGS. 1-7. Accordingly, the micro-grooves may exhibit a relatively high surface density up to a maximum of 600 micro-grooves per square millimeter, including all values and increments in the range of 1 to 600 micro-grooves per square millimeter.

Figure 2:
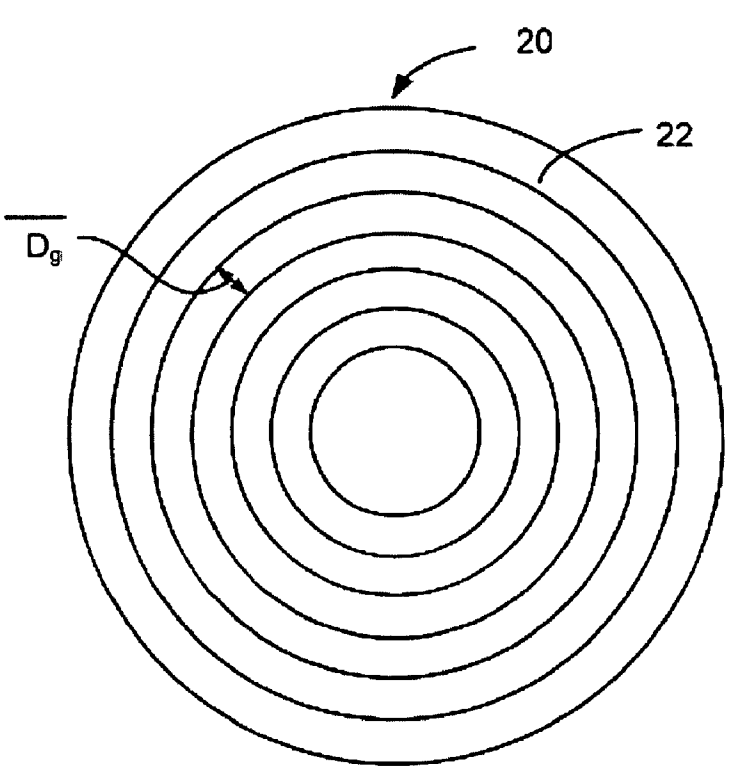
FIG. 2 is a topview of an exemplary embodiment of a polishing pad having circular micro-grooves.
Figure 1:
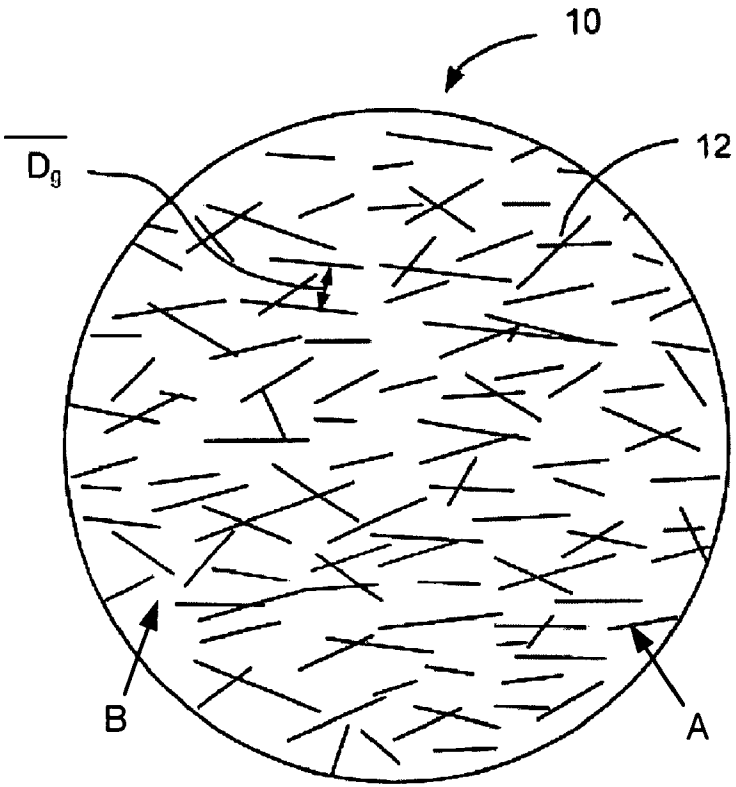
FIG. 1 is a topview of an exemplary embodiment of a polishing pad including randomized micro-grooves.
Figure 4:
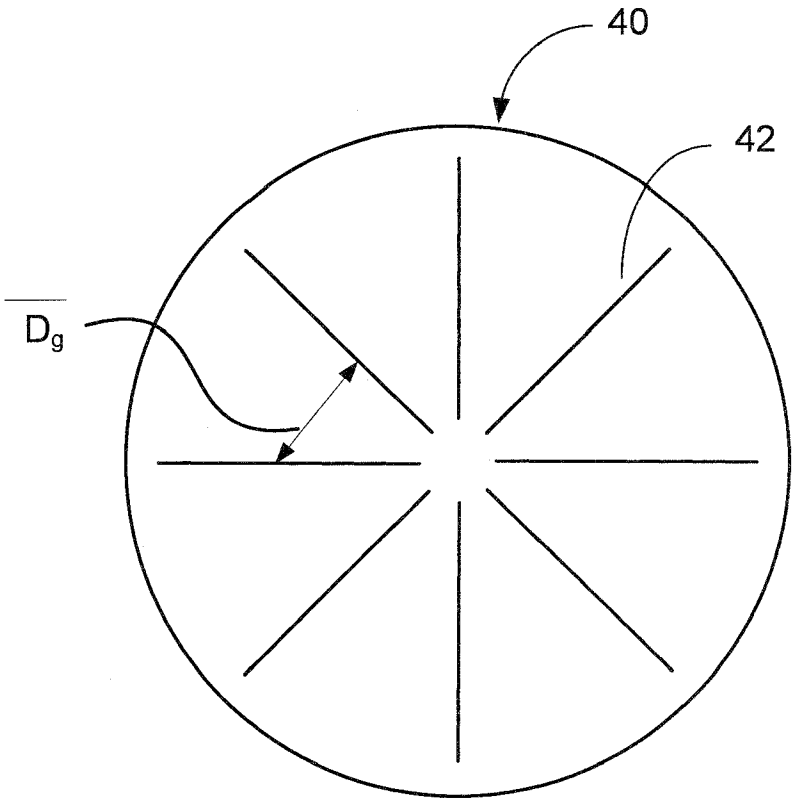
FIG. 4 is a topview of an exemplary embodiment of a polishing pad having radial micro-grooves.
Figure 3:
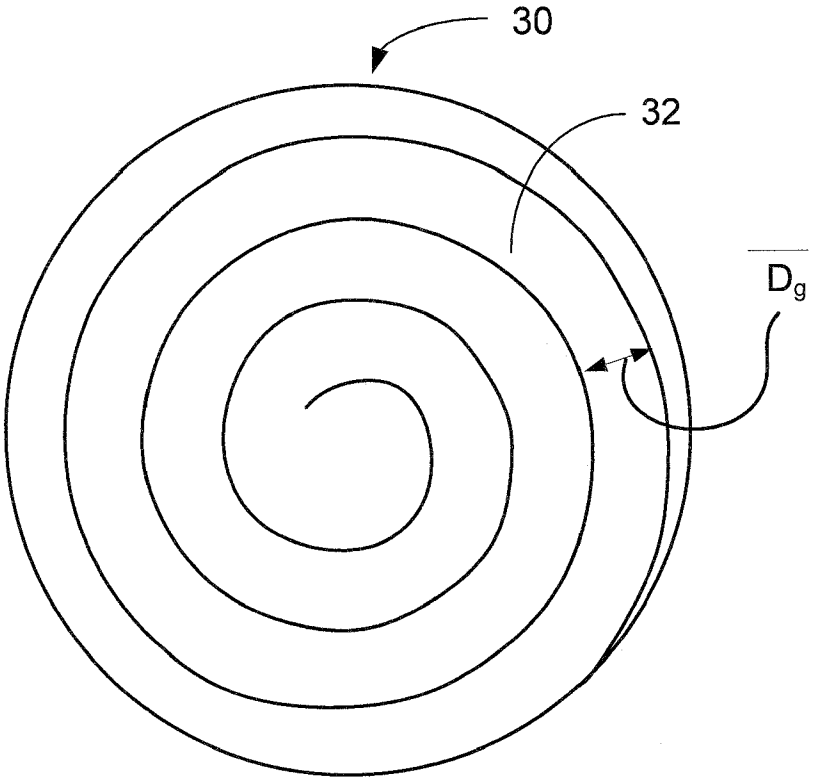
FIG. 3 is a topview of an exemplary embodiment of a polishing pad having spiral micro-grooves.
Figure 6:
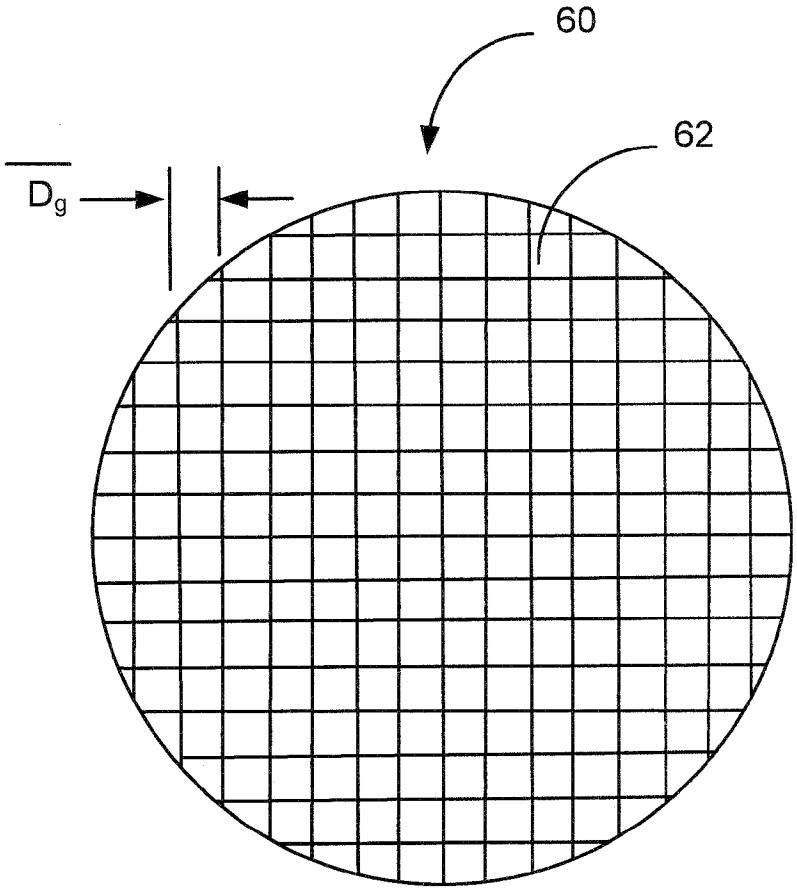
FIG. 6 is a topview of an exemplary embodiment of a polishing pad including crisscross micro-grooves.
Figure 5:
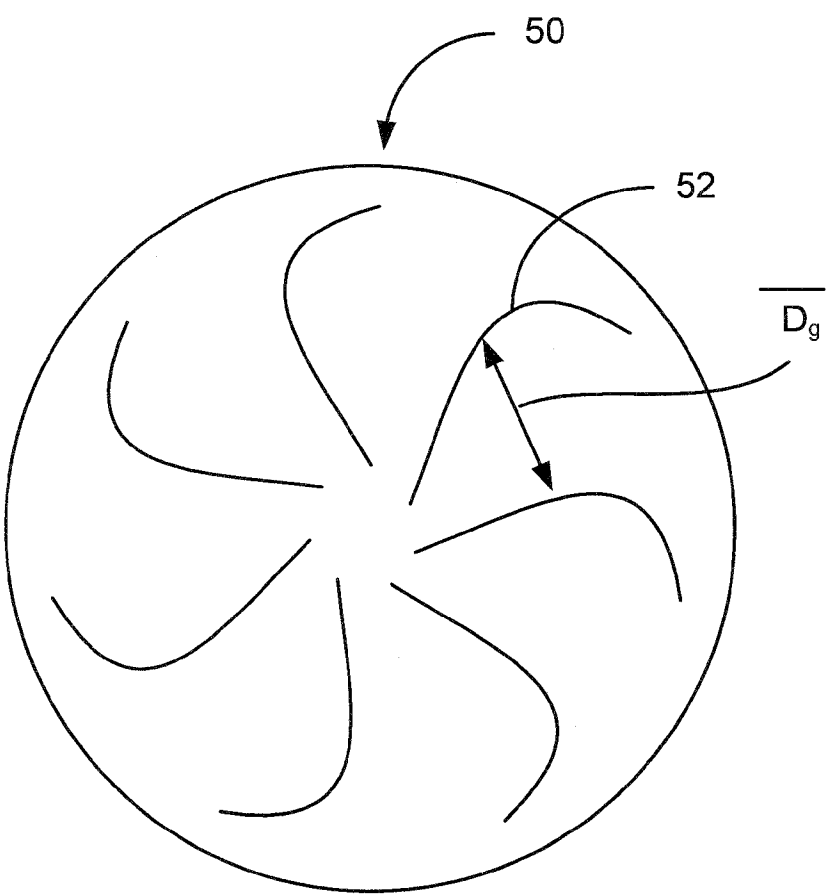
FIG. 5 is a topview of an exemplary embodiment of a polishing pad including centripetal micro-grooves.
Figure 7:
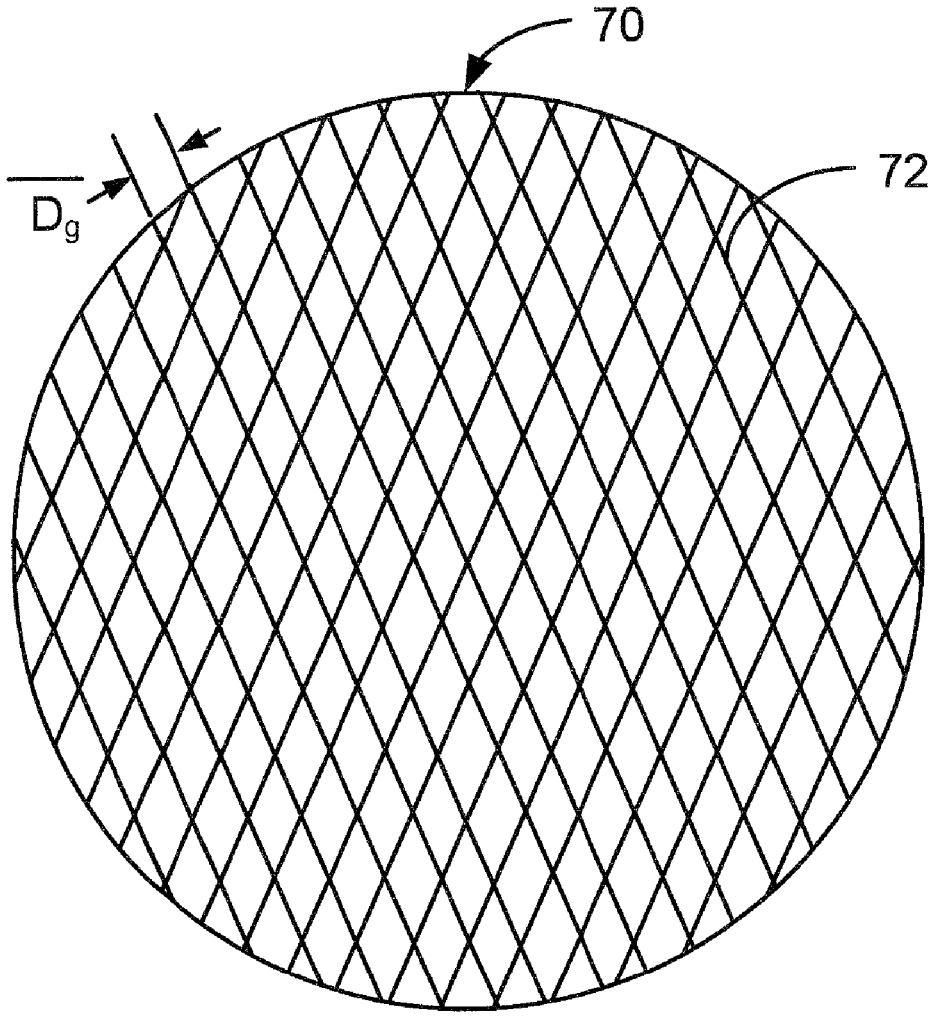
FIG. 7 is a topview of an exemplary embodiment of a polishing pad including diamond crisscross micro-grooves.

The micro-groove may be arranged in a number of arrays. Exemplary designs are illustrated in FIGS. 1-7, however, these designs are not limiting of the designs contemplated herein. For example, FIG. 1 illustrates an embodiment of an exemplary polishing pad 10 where the micro-grooves 12 crisscross each other in a randomized fashion. FIG. 2 illustrates an embodiment of an exemplary polishing pad 20 wherein the micro-grooves 22 are arranged in a circular, concentric fashion. FIG. 3 illustrates an embodiment of micro-grooves 32 arranged in a spiral fashion on a polishing pad 30. FIG. 4 illustrates an embodiment of micro-grooves 42 arranged in radial fashion on a polishing pad 40. FIG. 5 illustrates an embodiment of micro-grooves 52 arranged in centripetal fashion on a polishing pad 50, wherein the grooves extend from the center of the pad to its circumference. FIG. 6 illustrates an embodiment of a polishing pad 60 wherein the micro-grooves 62 are arranged a rectangular crisscross fashion, wherein the lines intersect in a substantially, perpendicular fashion. FIG. 7 illustrates an embodiment of micro-grooves 72 on a polishing pad 70 arranged in a crisscross fashion, wherein the lines intersect in a diamond, or non-perpendicular fashion. It may therefore be appreciated that one skilled in the art may readily recognize the potential number of arrays of micro-grooves that may be employed for uniform and efficient planarization of various devices.

In addition, as noted above, the micro-grooves in the present invention may be self-generating during the course of planarization. Such self-generation may be provided in the pad structure by combining a soluble component A within an otherwise insoluble matrix component B, wherein the soluble component may have a three-dimensional structure exhibiting a surface configuration, such as those described above and illustrated in FIGS. 1-7. In other words, the soluble fiber may be positioned such that from the surface through at least a portion of the thickness of the pad, the fiber is arranged to continuously dissolve in slurry and provide a selected regenerating micro-groove pattern in newly exposed surface of the pad, with respect to any surrounding and otherwise insoluble pad matrix component, (e.g., insoluble polymer resin or insoluble fibers or mixture of the two). In addition, the soluble fiber may be positioned through the entire thickness of the pad. It should also be appreciated that the soluble fiber giving rise to a particular regenerating groove pattern may be configured such that the groove pattern changes at a desired depth within the pad. Accordingly, at any given point in a polishing cycle, the pattern on the surface may appear, e.g., as shown in FIGS. 1-7.

Sources of the soluble component may include various nonwoven fibrous and fabric structures as well as various woven and knitted fibrous fabric structures. Other sources of the soluble component may include various extruded and molded soluble polymer structures. Further sources of the soluble component may include deposition product where physical and/or chemical deposition, etching or nano-particle aggregation techniques are employed to make up the soluble component.

The soluble component may include water-soluble substances. For example, the soluble component may include a component that is completely soluble in water or partially soluble. For example, the soluble component may be 100% soluble in water, or between 50-100% soluble, including all values and increments therein. In addition, it is contemplated that the solubility may be selected based upon temperature considerations. For example, the solubility may be selected such that it may vary according to the temperature of the slurry. Examples of water-soluble substances may include, but not be limited to, polyvinyl alcohol (with varying degrees of alcoholysis, e.g. 75-100% hydroxyl functionality). It may be appreciated that varying degrees of hydroxyl functionality (—OH) on the polymer chain may allow for a component that may be soluble in water at different temperatures, e.g., relatively higher concentration of —OH functionality requiring relatively higher temperature water for dissolution). Other soluble substances may include poly(vinyl alcohol)-co-polyvinyl acetate, polyacrylic acid, maleic acid, polysaccharides, cyclodextrin, copolymers and derivatives of the above substances as well as various water-soluble inorganic salts, hydrogels, gums and resins.

In an exemplary embodiment, a soluble component A may be made of a three-dimensional, needlepunched nonwoven fabric including randomly oriented water-soluble polyvinyl alcohol fibers which may then provide the groove pattern illustrated in FIG. 1. The nonwoven fabric may be placed inside the recessed area of a molding plate of a commercial molding device. Such conventional molding device may include a bottom plate having a recess area and a top plate that fits on top of the bottom plate under pressure. Both the top plate and bottom plate may be fitted with multi-zone heating elements, which may regulate the temperature across the surface of both plates. In addition, the speed with which the plates come together in contact, and the time during which they stay closed together, (i.e., mold close or dwell time) may be regulated. The motion and compression of the plates may be facilitated by electric, hydraulic or pneumatic means.

A polymeric liquid material, such as a mixture of polyurethane prepolymer and a curing agent, therein providing insoluble matrix component B, may then dispensed inside the recessed area of the bottom plate onto the nonwoven fabric, i.e., component A. An insoluble component herein may therefore be understood to amount to any material that is otherwise insoluble in the polishing slurry. The dispensing of the mixture on the fabric may be completed in a uniform manner. Once the mixture is dispensed on the fabric, the plates of the molding device may be closed together leaving a pre-determined space in the recess area in the bottom plate where the fabric and the mixture are enclosed under specified temperature and pressure for a predetermined mold close time. Under pressure between the plates, the polyurethane prepolymer and curing agent mixture may fill at least a portion of the interstices of the nonwoven fabric, and is subsequently cured by chemical reaction into a solid. Thus, at least a portion or completely all of the nonwoven fabric may be encapsulated within the cured prepolymer.

Temperature profiles that may be specified to produce the polishing pad may range from 100° F. to 350° F., including all values and increments therein. Pressure profiles that may be specified to produce the polishing pad may range from 20 lbs to 250 lbs per square inch, including all values and increments therein. The "mold close" or "dwell time" may vary from 1 to 30 minutes, including all values and increments therein, depending on the type of polyurethane and curing agent. The cured polyurethane-encapsulated-nonwoven pad may subsequently be annealed, which may impart a desired molecular morphology.

The cured polyurethane-encapsulated-nonwoven pad may then be subjected to a de-skinning operation, whereby a thin layer varying from 2 to 10 thousandths of an inch, including all values and increments therein, may be removed from one surface of the pad to expose at least a portion of the fabric. The de-skinning operation may occur on one or more surfaces of the pad. A layer of adhesive may be laminated to a side of the pad. The layer of adhesive may be a double-face adhesive and may be adhered to a non-polishing side of the pad. Prior to polishing, the pad may be adhered to the tool surface with the installed double-face adhesive.

During the polishing process, the surface layer of the pad may be exposed to a continuous flow of aqueous water-based slurry containing an abrasive and subjected to the continuous cutting action of a conditioner, as described above. The soluble fibers on the pad surface may dissolve in the water-based slurry and may be removed by the flow of the slurry and conditioning. The dissolved fibers may therefore leave behind longitudinal indentations in the form of micro-grooves. Since the soluble fibers may be fixed in position within the pad by the encapsulating polymeric component B, the micro-grooves generated as a result of the dissolution of the soluble fibers may also be fixed in the same position. Furthermore, as conditioning continues to wear away the top surface of the pad, new random arrays of the nonwoven fabric may be exposed to the water-based slurry thus continuing to generate new arrays of micro-grooves.

While the polymeric encapsulating component B may contribute to the bulk properties of the polishing pad, the water-soluble nonwoven fabric component A may contribute to the self-generating array of micro-grooves on the pad surface. There may therefore exist a degree of design flexibility to effect a variety of pads for different polishing applications. Accordingly, one may control the properties of the polishing pad by altering various factors. For example, the size or diameter of the soluble fibers in the nonwoven fabric may be altered, wherein the soluble fiber diameters may be in the range of 5 to 80 micrometers, including all values and increments therein. As alluded to above, the type of water soluble fibers may be selected based on rate of dissolution for the particular chemical composition of the slurry.

Chemical substances, such as surface-active agents, catalysts, pH buffers, etc., may be incorporated into the fibers, and subsequently released into the slurry upon the dissolution of the fibers during polishing. Such substances may therefore be used to aid in the polishing process. It should be noted that the volume or weight ratio of the soluble component A to the insoluble component B may vary from 10:90 to 90:10, including any values therein, which may be adjusted depending on the desired surface density of the micro-grooves to be formed on the pad surface. For example, the weight percent of the soluble component may be present at about 10-90% and the weight percent of the insoluble component may be present at about 90-10%, including all values and increment therein. In addition, the thickness or depth of the nonwoven fabric in the pad may be altered, such that the nonwoven component may extend through at least a portion of or completely through the thickness of the polishing pad.

As noted above, the nonwoven fabric component A may specifically include water-soluble and water insoluble fibers. Exemplary water-insoluble fibers materials may include, but are not limited to, polyester, polypropylene, polyamide, polyimide, polyacrylic, polyphenylene sulfide, polytetrafluoroethylene, rayon (regenerated cellulose) and various natural fibers (e.g. cotton, silk). The presence of such fibers on the pad surface has been shown to reduce scratching defects in polishing devices, such as semiconductor devices.

In yet another embodiment, a mixture of water-soluble and water-insoluble fibers in the nonwoven fabric component A may include insoluble fibers selected from a group of fibers having lower melting temperatures than the water soluble fibers. Accordingly, the water soluble fibers may have a melting point $Tm_1$ and the insoluble fibers may have a melting point $Tm_2$ wherein $Tm_2<Tm_1$. Such water-insoluble fibers may also include, but are not limited to, bi-component polyester and polyolefin fibers that consist of relatively low melting and high melting components within an individual fiber (i.e., one fiber component has a melting point that is less than the other component). Accordingly, the bicomponent fiber may include a first component having a first melting temperature $Tc_1$ and a second component having a second melting temperature $Tc_2$, wherein $Tc_1<Tc_2$. In addition, such fibers may include binder fibers including only relatively low melting components.

In the above described embodiment, a polymer component (as a binder) may not be necessary to form the pad. Rather, the nonwoven fabric consisting of a mixture of water-soluble and water-insoluble fibers, constituting the insoluble component, may be subject to heat and pressure which may compress the fabric while melting the low-melting fibers. The molten fibers which may fill the interstices within the fabric, may then harden upon cooling and bond the fabric together into the polishing pad.

Other embodiments, as alluded to above, may employ nonwoven or woven fabrics designed to create micro-grooves having circular, spiral, centripetal, rectangular or diamond shape crisscross patterns on the pad surface. For example, plain weave fabrics, i.e., one-up-one down nonwoven fabric may be made with water-soluble fibers, which may give rise to a micro-groove structure having a rectangular, crisscross pattern.

In addition to the micro-grooves, a plurality of macro-grooves may be provided in the pad surface. As mentioned earlier, the macro-grooves may have individual groove widths of 0.010 inches to 0.050 inches, including all values and increments therein, depths of 0.010 inches to 0.080 inches, including all values and increments therein and distances between adjacent grooves of 0.12 inches to 0.25 inches, including all values and increments therein. Such grooves may improve efficient slurry flow, heat dissipation and debris removal. Accordingly, the presence and number or design of the macro-grooves may depend on the given application, type of slurry and nature of the substrate to be polished.

Accordingly, it can be appreciated that the self-forming micro-grooves described herein, either alone or in combination with any of the additional features noted above, may provide improved planarization of the polished substrate. The micro-grooves may provide an interconnecting network of relatively fine distribution channels for intimate and uniform contact between the abrasive particles in the slurry and the polished substrate, and may reduce localized heat build-up, remove polish debris and by-products. In addition, the presence of the micro-grooves may improve slurry usage. In a conventional polishing pad, a high percentage of the slurry may be lost as it may slide off the surface of the pad and the macro-grooves without interacting with the polished substrate. The micro-grooves presently utilized herein may therefore increase retention and finely distribute the slurry thus maximizing contact with a polished substrate while also allowing for relatively reduced slurry consumption and cost savings. It may be expected that a 20 to 40% reduction in slurry usage may be achieved using the pad of the present invention.

Furthermore, due to the absence or reduction of macro-grooves, the useful life of the polishing pad, described herein, may be longer than that of a conventional pad including only macro-grooves. The absence or reduction of the macro-grooves may also increase the polishing surface presented for polishing and the need for conditioning to expose new surfaces may therefore be reduced. Reducing conditioning may reduce polishing pad wear and may therefore prolong the useful life of the pad.

The foregoing description of several methods and an embodiment of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A polishing pad for use with polishing slurry comprising:

a nonwoven fabric including a plurality of soluble fibers having a diameter in the range of 5 to 80 micrometers, wherein said soluble fibers comprise one or more of nonwoven fibrous and fabric structures, woven and knitted fibrous and fabric structures, and an insoluble component, wherein said pad has a thickness and includes a first surface having a plurality of interconnected self-generating micro-grooves, wherein said soluble fibers are positioned through at least a portion of the thickness of the pad to continuously dissolve and form said micro-grooves in a newly exposed surface of said pad by exposure to said slurry, said micro-grooves having a width and/or depth in the range up to 150 micrometers, and wherein said micro-grooves are arranged in an array of longitudinal indentations in said first surface of said pad and retain and distribute said polishing slurry and said self-generating microgrooves are arranged in one of a crisscross, circular, spiral, radial, or centripetal arrays.

2. The polishing pad of claim 1, further comprising an average distance present between said grooves, wherein said average distance is in the range of 10 to 2000 micrometers.

3. The polishing pad of claim 1, wherein said insoluble component comprises a polymer component.

4. The polishing pad of claim 1, wherein the weight percent of said soluble fibers is about 10-90% and the weight percent of said insoluble component is about 90-10%.

5. The polishing pad of claim 1, wherein said insoluble component includes an insoluble fiber.

6. The polishing pad of claim 5, wherein said soluble fiber has a first melting temperature $Tm_1$ and said insoluble fiber has a second melting temperature $Tm_2$, wherein $Tm_2<Tm_1$.

7. The polishing pad of claim 5, wherein said insoluble fiber is a binder fiber.

8. The polishing pad of claim 5, wherein said insoluble fiber is a bi-component fiber consisting of a first component having a first melting temperature $Tc_1$ and a second component having a second melting temperature $Tc_2$, wherein $Tc_1<Tc_2$.

9. The polishing pad of claim 1, wherein said pad further comprises a second surface and an adhesive present on said second surface.

10. The polishing pad of claim 1, further comprising a chemical substance incorporated into said soluble fibers, wherein the chemical substance is selected from the group consisting of surface-active agents, catalysts and pH buffers.

11. The polishing pad of claim 1 wherein the insoluble component comprises an insoluble polymer resin and an insoluble fiber.

12. The polishing pad of claim 1, wherein said micro-grooves in said pad having a width and/or depth in the range of 5-150 micrometers.

13. A polishing pad for use with polishing slurry comprising:

a nonwoven fabric including a plurality of soluble fibers having a diameter in the range of 5 to 80 micrometers, wherein said soluble fibers comprise one or more of nonwoven fibrous and fabric structures, woven and knitted fibrous and fabric structures, and an insoluble component comprising an insoluble fiber, wherein said pad has a thickness and includes a first surface having a plurality of interconnected micro-grooves, wherein said soluble fibers are positioned through at least a portion of the thickness of the pad to continuously dissolve and form said micro-grooves in a newly exposed surface of said pad by exposure to said slurry, said micro-grooves having a width and/or depth in the range up to 150 micrometers wherein said micro-grooves are arranged in an array of longitudinal indentations in said first surface of said pad and retain and distribute said polishing slurry and said self-generating microgrooves are arranged in one of a crisscross, circular, spiral, radial, or centripetal arrays.

14. The polishing pad of claim 13, wherein said soluble fiber has a first melting temperature $Tm_1$ and said insoluble fiber has a second melting temperature $Tm_2$, wherein $Tm_2<Tm_1$.

15. The polishing pad of claim 13, wherein said insoluble fiber is a binder fiber.

16. The polishing pad of claim 13, wherein said insoluble fiber is a bi-component fiber consisting of a first component having a first melting temperature $Tc_1$ and a second component having a second melting temperature $Tc_2$, wherein $Tc_1<Tc_2$.

17. The polishing pad of claim 13, wherein said soluble fibers are positioned through the entire thickness of the pad.

18. A polishing pad which provides a relatively high surface density of microgrooves upon exposure to aqueous media comprising:

a nonwoven fabric including a plurality of soluble fibers having a diameter in the range of 5 to 80 micrometers, wherein said soluble fibers comprise one or more of nonwoven fibrous and fabric structures, woven and knitted fibrous and fabric structures, and an insoluble component, wherein said pad has a thickness and includes a first surface having a plurality of interconnected self-generating micro-grooves, wherein said soluble fibers are positioned through at least a portion of the thickness of the pad to dissolve and form said micro-grooves in a newly exposed surface of said pad by exposure to said aqueous media, said micro-grooves having a width and/or depth in the range up to 150 micrometers, and wherein said micro-grooves are arranged in an array of longitudinal indentations in said first surface of said pad to retain and distribute a polishing slurry and said self-generating microgrooves are arranged in one of a criss-cross, circular, spiral, radial, or centripetal arrays.

* * * * *